US005171078A

United States Patent [19]

Oslin et al.

[11] Patent Number: 5,171,078

[45] Date of Patent: Dec. 15, 1992

[54] CABINET DOOR ARRANGEMENT

[75] Inventors: G. Robert Oslin; Edward Droho, both of Chicago, Ill.

[73] Assignee: Delaware Capital Formation, Inc., Wilmington, Del.

[21] Appl. No.: 875,975

[22] Filed: Apr. 29, 1992

Related U.S. Application Data

[63] Continuation of Ser. No. 669,051, Mar. 14, 1991, abandoned.

[51] Int. Cl.[5] ..... A47B 88/00

[52] U.S. Cl. ..... 312/325; 49/193

[58] Field of Search ..... 49/193, 149; 312/324, 312/325

[56] References Cited

U.S. PATENT DOCUMENTS

| | | | |
|---|---|---|---|
| 1,070,502 | 8/1913 | Madigan | 49/193 |
| 1,391,133 | 9/1921 | Matchette . | |
| 1,673,291 | 6/1928 | Matchette . | |
| 2,783,115 | 2/1951 | York | 49/193 |
| 3,378,954 | 4/1968 | Sandin | 49/193 |
| 3,380,192 | 4/1968 | McKenna . | |
| 3,874,114 | 4/1975 | Robinson . | |
| 3,889,419 | 6/1975 | Maleck | 49/193 |
| 4,132,034 | 1/1979 | Van Siclen | 49/193 |

*Primary Examiner*—Joseph Falk
*Attorney, Agent, or Firm*—Welsh & Katz, Ltd.

[57] ABSTRACT

A door arrangement for a cabinet or the like having an access opening communicating with an internal compartment includes an inner door mounted on the cabinet for movement about a first hinge axis to facilitate access to the cabinet compartment. The inner door has an opening therethrough and carries a second door for hinged movement about a second hinge axis laterally offset from the first hinge axis to facilitate access to the cabinet compartment by hinged movement about the second hinge axis, access to the cabinet compartment thus being obtainable by selective right-hand or left-hand opening of the door arrangement.

15 Claims, 1 Drawing Sheet

FIG. 1
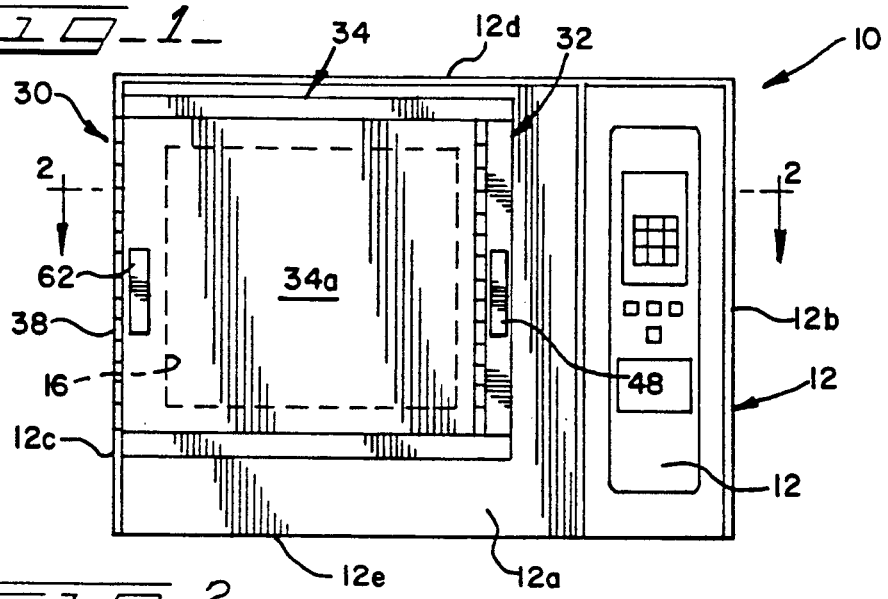
FIG. 2
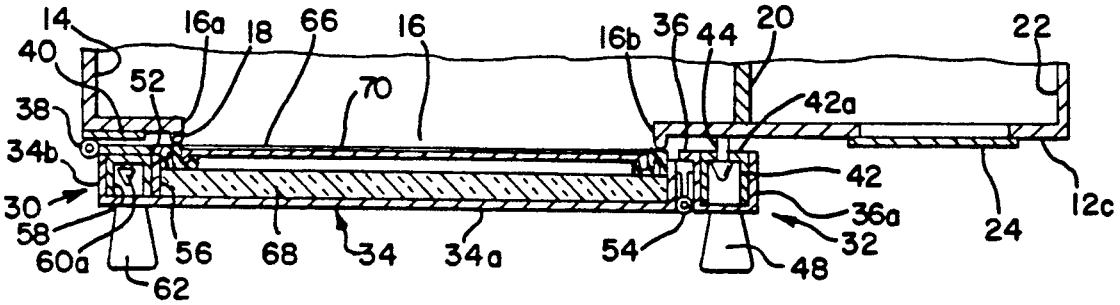
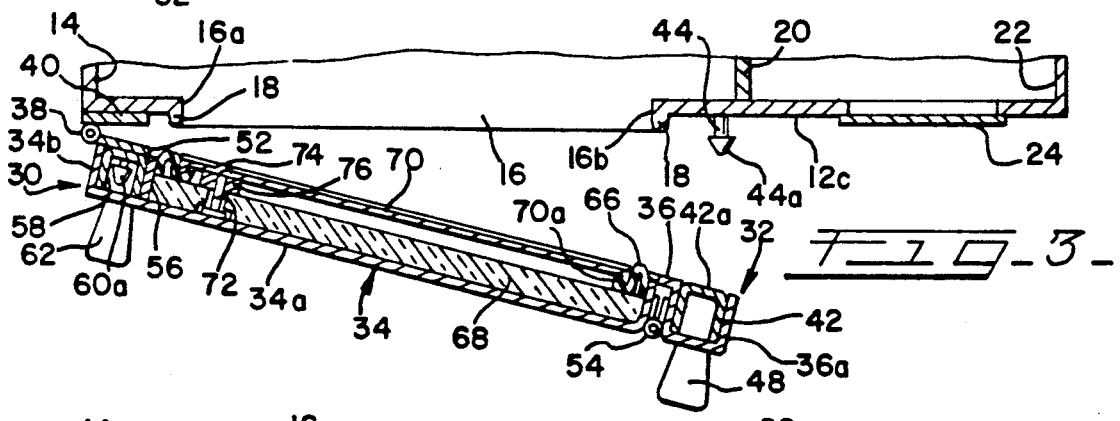
FIG. 3
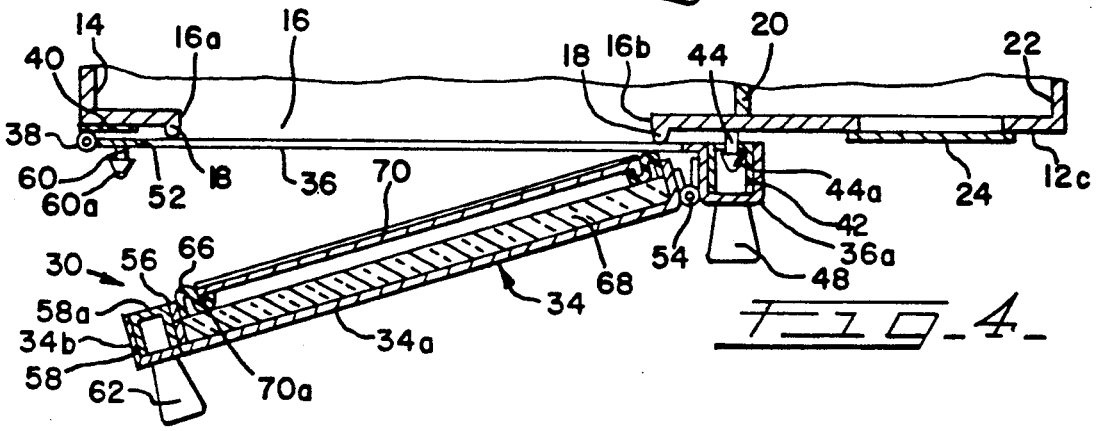
FIG. 4

CABINET DOOR ARRANGEMENT

This is a continuation of application Ser. No. 07/669,051, filed Mar. 14, 1991, now abandoned.

BACKGROUND OF THE INVENTION

The present invention relates generally to cabinets and the like having hinged doors enabling access to internal compartments, and more particularly to such a cabinet having a novel door arrangement enabling access to an internal compartment by right-hand or left-hand opening of a door, thus facilitating access from opposite sides of the cabinet door.

It is a common practice when mounting a door on a cabinet or the like to provide either a left-hand or right-hand hinge axis depending on the intended location of the cabinet or other restrictions which might inhibit access to the door or full opening thereof. The conditions which suggest a particular hinge axis location generally apply equally to free standing cabinets, such as large commercial ovens and upstanding refrigerators and freezer units, and smaller size cabinets which may be supported on a countertop or support stand. Substantial economic savings can be realized when installation and accessibility considerations for a cabinet are minimized without hindering ease of opening and closing the cabinet door.

SUMMARY OF THE INVENTION

One of the primary objects of the present invention is to provide a novel door arrangement for a cabinet or the like wherein access to a compartment within the cabinet may be obtained by right-hand or left-hand opening of an access door arrangement.

A more particular object of the present invention is to provide a novel door arrangement for a cabinet or the like defining an internal compartment accessible through an access opening, wherein a first door is mounted on the cabinet for movement about a first substantially vertical hinge axis to enable opening and closing of an access opening in the cabinet, and wherein a second door is hingedly mounted on the first door for movement about a second substantially vertical hinge axis spaced laterally opposite the first hinge axis so as to enable access to the cabinet through an access opening in the first door, thereby facilitating access to the cabinet by selective right-hand or left-hand opening of the door arrangement.

A feature of the door arrangement in accordance with the present invention lies in forming the first door as a generally rectangular open-centered frame non-releasably hinged to the cabinet and extending about the periphery of the cabinet access opening, and mounting the second door on the rectangular frame for movement with the frame and for hinged movement independent of the frame about a non-releasable generally vertical hinge axis spaced laterally from the frame hinge axis to enable access to the cabinet through selective left-hand or right-hand opening of the first and second doors. Another feature of the cabinet door arrangement in accordance with the present invention lies in providing sealing means between the cabinet and the outer or second door to provide a seal about the periphery of the cabinet access opening when the first and second doors are in closed relation with the cabinet.

Further objects, features and advantages of the invention will become apparent from the following detailed description of the invention when taken in conjunction with the accompanying drawing wherein like references numbers designate like elements throughout the several views.

BRIEF DESCRIPTION OF THE DRAWING

FIG. 1 is a front elevation view of a cabinet having a door arrangement constructed in accordance with the present invention;

FIG. 2 is a fragmentary transverse sectional view, on an enlarged scale, taken substantially along line 2—2 of FIG. 1;

FIG. 3 is a fragmentary transverse sectional view similar to FIG. 2 but showing the door arrangement opened about a left-hand hinge axis; and FIG. 4 is a fragmentary transverse sectional view similar to FIG. 3 but showing the door arrangement opened about a right-hand hinge axis.

DETAILED DESCRIPTION

Referring now to the drawing, a cabinet incorporating a door arrangement constructed in accordance with the present invention is indicated generally at 10 in FIG. 1. In the illustrated embodiment, the cabinet 10 includes a substantially rectangular three-dimensional housing 12 having a front wall 12*a*, laterally opposite side walls 12*b* and 12*c*, a top wall 12*d* and a bottom wall 12*e* which are secured to each other along mutually engaging marginal edges so as to lie in mutually perpendicular planes. The rearward marginal edges of the side walls, top wall and bottom wall are preferably releasably secured to a rear wall (not shown) disposed parallel to the front wall 12*a*. The cabinet 10 may, for example, constitute a cabinet for an oven of a size enabling it to be supported on a countertop or support stand. Alternatively, the cabinet 10 may take the form of a free standing cabinet such as employed in refrigerators, freezers and relatively large commercial ovens of the type employing upper and lower oven compartments.

In the illustrated embodiment, the rectangular housing 12 forms the external shell for an oven having an internal oven compartment 14. Access to compartment 14 is provided through a generally rectangular access opening 16 in the front wall 12*a* defined by substantially vertical laterally opposed marginal edges 16*a* and 16*b*. An outwardly extending flange or lip 18 is formed about the full periphery of the access opening 16 and has a rounded outer surface which serves as a sealing flange or lip, as will be described. The opening 16 is off-set from the center 16 axis of the rectangular housing 12 such that the left-hand edge of opening 16 is disposed closely adjacent the left-hand side wall 12*c* of the cabinet. An upstanding wall 20 is supported internally of housing 12 in parallel relation to the side walls and establishes the right-hand margin or wall of the internal compartment 14.

The internal wall 20 is spaced from the right-hand end wall 12*b* of housing 12 to establish a compartment 22 for housing various components and electronic controls (not shown) for the oven. A control panel 24 is supported on the front cabinet wall 12*a* forwardly of compartment 20 and supports suitable control buttons, dials and/or switches for controlling operation of the oven in a known manner. The oven compartment 14 will generally house an internal insulated oven shell having heating means associated therewith and having means to support shelf racks and the like for supporting items to be heated within the oven compartment. An example of an oven of the type thus far described is disclosed in U.S. Pat. No. 4,851,644 which is incorporated herein by reference. Such ovens are commercially available from Groen/Dover Corporation, Elk Grove Village, Ill.

In accordance with the present invention, the cabinet 10 includes a door arrangement or system, indicated generally at 30, which enables access to the internal compartment 14 by selective opening of the door arrangement about either a left-hand or right-hand hinge axis. This is a significant advantage when access to the cabinet, and thereby the door arrangement 30, is restricted or otherwise impeded so that the ability to open the access door from either its left-hand or right-hand sides offers substantially improved operating efficiency and reduces installation or location considerations.

The door arrangement 30 includes a first or inner door 32 which is hinged to cabinet housing 12 for opening about a left-hand hinge axis, and a second or outer door 34 which is hinged to the inner door for opening about a right-hand hinge axis. The first or inner door 32 takes the form of a substantially rectangular open-centered frame which includes a generally planar metallic plate portion 36 having an intermittent or longitudinally segmented hinge sleeve 38 fixed to or formed integral with a vertical left-hand edge of the frame. The hinge sleeve 38 is adapted for hinged connection through a hinge pin to a complimentary hinge sleeve formed on a hinge plate 40 which is secured to the forward housing wall 12*a* adjacent the left-hand marginal edge 16*a* of access opening 16. In this manner, the inner door 32 is mounted for hinged movement about a first vertical hinge axis generally adjacent the left-hand boundary 16*a* of the rectangular access opening 16 in the cabinet housing.

The rectangular door plate 36 is of sufficient size to overlie the full periphery of the cabinet access opening 16 and has a right-hand edge or margin 36*a* which is formed as a generally U-shaped channel in transverse cross-sectional configuration. Suitable latch means are provided to enable releasable latching of door 32 in a closed position relative to the cabinet housing 12. A generally U-shaped channel member 42 is fixed within the channel shaped edge 36*a* of the inner door plate 36 so as to establish an outer wall 42*a* which is generally coplanar with the planar plate 36. The wall 42*a* has an opening therethrough positioned to receive latch means in the form of a latch pin or bullet 44 which is fixed to and extends outwardly from the front housing wall 12*a* adjacent the right-hand marginal edge 16*b* of the cabinet access opening. The latch pin 44 has an enlarged conical head 44*a* adapted to be received through the opening in the channel wall 42*a* of door plate 36 when in closed position. Complimentary latch means (not shown) are carried within the channel formed between the channel shaped edge 36*a* of door plate 36 and the associated channel member 42 to releasably couple with the head 44*a* of the latch pin 44 when the inner door is in closed position relative to the cabinet front wall 12*a*. The complimentary latch means may take the form of an inverted generally U-shaped wire spring carried on the inner surface of the channel wall 42*a* such that legs of the spring are disposed adjacent the latch pin receiving opening in wall 42*a* and resiliently straddle the latch pin 44 when the inner door 32 is in closed position. A door handle 48 is mounted on the outer surface of the channel shaped right-hand edge 36*a* of the inner door plate 36 for limited vertical movement. The handle 48 has a wedge shaped latch release member which extends into the channel edge 36*a* to enable release of the spring legs from the latch pin. An example of a latch mechanism of this type is disclosed in the aforementioned U.S. Pat. No. 4,851,644 which is incorporated herein by reference.

The plate portion 36 of the inner door 32 has a rectangular opening 52 formed therethrough of a size slightly larger than the access opening 16 in the cabinet housing 12 so that opening 52 is centrally aligned with opening 16 when the inner door is in closed position. In accordance with present invention, the second or outer door 34 of the door assembly 30 is hinged to the inner door 32 through a hinge connection 54 which enables opening and closing of the inner door opening 52, and thereby the cabinet access opening 16, independently of the inner door 32. The hinge axis 54 is disposed parallel to and laterally offset from the hinge axis 38. The outer door 34 is of similar size to the plate portion 36 of the inner door and is preferably made from suitable strength sheet metal. The outer door 34 has a planar outer wall 34*a* having an in-turned right-angle flange formed about its full outer periphery, such as indicated at 34*b*. The right-hand flange 34*b* is connected to a hinge plate of the hinge connection 54. A plate 56 is fixed to the inner surface of the outer door wall 34*a* in parallel spaced relation to the left-hand flange 34*b*. A U-shaped channel 58 is fixed to and between the left-hand flange 34*b* and plate 56 so as to establish an outer surface 58*a* coplanar with the outer marginal edge of the peripheral flange 34*b*.

To facilitate releasable latching of the outer door 34 in closed relation with the inner door 32, a latch pin or bullet 60 is fixed to and extends outwardly from the inner door plate 36 generally adjacent the hinge axis 38 and intermediate the vertical height of the inner door. The latch pin 60 is substantially identical to the latch pin 44 and has an enlarged generally bullet-shaped or conical head 64*a* adapted to be received through a suitable opening (not shown) formed in the opposed outer surface 58*a* of channel 58. The outer door 34 carries latching means within the channel 58 for releasably latching or coupling with the latch pin 60, such as a resilient spring-type catch as described for the inner door 32. A handle 62 is carried on the outer door 34 for vertical movement to release the spring catch from the latch pin 60 in similar fashion to handle 48 on the inner door 32.

The outer door 34 carries a continuous rectangular seal 66 which is configured to extend through the rectangular opening 52 in the inner door and seal against the outer surface of the flange or lip 18 peripherally of the cabinet access opening 16 when the outer and inner doors are in closed relation with the cabinet 12. The seal 66 is generally S-shaped in transverse cross-sectional configuration and is retained against a rectangular insulation panel 68. The insulation panel 68 is preferably made from rigid insulation board and fills the area of the outer door within the perimeter defined by the plate 56 and the top, bottom and right-hand flanges 34*b*. A rigid rectangular plate 70 has a peripheral right-angle flange 70*a* which engages the seal 66 to retain it against the insulation panel. The plate 70 is, in turn, mounted on the outer door 34 through a plurality of headed nuts, one of which is illustrated at 72 in FIG. 3, which extend through the insulation panel and receive headed screws 74. Spacers 76 maintain the plate 70 in predetermined spaced relation to the insulation panel 68.

In operation, the outer door 34 is generally latched in closed relation with the inner door 32 as illustrated in FIGS. 2 and 3. When it is desired to access the internal compartment 14 in the cabinet housing 12 through the access opening 16, such access may be obtained through either right-hand or left-hand opening of the door assembly 30. For example, should it be convenient to open the door assembly about a left-hand hinge axis, the operator manipulates the handle 48 to open both the inner and outer doors while in latched relation to each other as illustrated in FIG. 3. On the other hand, should it be inconvenient or otherwise more difficult to open the door assembly about the left-hand hinge axis 38 by means of handle 48, the operator may manipulate handle 62 to open the outer door 34 about the right-hand hinge axis 54 relative to the inner door 32, thereby exposing opening 52 in the inner door for access to the cabinet compartment 14.

The ability to open the cabinet door assembly 30 about either a left-hand or right-hand hinge axis through grasping of the right-hand or left-hand handles, respectively, greatly improves the convenience of accessing the cabinet compartment 14. This is particularly important when the cabinet 10 is located or positioned where it is more convenient to open the door assembly about one hinge axis rather than the other.

While a preferred embodiment of the present invention has been illustrated and described, it will be understood to those skilled in the art the changes and modifications may be made therein without departing from the invention in its broader aspects. For example, the particular construction of the inner and outer doors 32 and 34 may take a number of alternative designs while maintaining the characteristics of optional left-hand or right-hand opening of the door arrangement or assembly. Various features of the invention are defined in the following claims.

What is claimed is:

1. In a cabinet having an internal compartment and an access opening communicating with said compartment to enable access thereto, the combination therewith comprising a door arrangement including a first door of a size sufficient to cover said access opening, first hinge means fixedly connecting said first door to said cabinet generally adjacent a perimeter of said access opening to enable hinged movement of said first door about a first substantially vertical hinge axis to open and close said cabinet access opening, said first door having an opening therethrough generally aligned with said cabinet access opening, a second door of a size sufficient to cover said first door opening, second hinge means connecting said second door to said first door to enable hinged movement of said second door about a second substantially vertical hinge axis laterally offset from said first hinge axis to open and close said first door opening, said hinge axes defining left-hand and right-hand hinge axes whereby access to said compartment may be effected by selective right-hand or left-hand opening of said first and second doors, said second door carrying seal means operative to seal with the perimeter of said access opening when said first and second doors are in positions closing said access opening.

2. A cabinet as defined in claim 1 wherein said cabinet access opening is generally rectangular and has substantially vertical laterally opposite side edges, said first door comprising a generally rectangular open-centered frame member hinged to the cabinet so as to extend about the periphery of said access opening, said first hinge means defining said first hinge axis adjacent one of said opposite side edges of said cabinet access opening, said second door being hinged to said frame member so as to overlie said open center, said second hinge means defining said second hinge axis spaced laterally from said first hinge axis.

3. A cabinet as defined in claim 2 wherein said first door opening is formed in said rectangular frame member as a rectangular opening of a size substantially equal to said cabinet access opening, said second door being moveable about said second hinge axis to enable access to said compartment through said rectangular opening.

4. A cabinet as defined in claim 3 wherein said second door is substantially equal in size to an outer perimeter of said rectangular frame member, said second hinge axis being disposed adjacent an edge of the first door laterally opposite said first hinge axis.

5. A cabinet as defined in claim 1 including latch means cooperable with said first and second doors to facilitate latching of said second door to said first door for movement therewith about said first hinge axis.

6. A cabinet as defined in claim 1 including first latch means facilitating releasable latching of said first door in closed relation to said cabinet, and second latch means carried by said second door and enabling latching of said second door to said first door for movement therewith about said first hinge axis.

7. A cabinet as defined in claim 1 wherein said seal means carried by said second door is operative to extend through said opening in said first door for sealing relation with said cabinet peripherally of said cabinet access opening when said door arrangement is in closed relation with said first door.

8. A cabinet and door arrangement wherein the cabinet has an internal compartment and an access opening providing access to the compartment, said door arrangement comprising, in combination, a first door hingedly connected to said cabinet for movement about a first substantially vertical hinge axis between a closed position covering said cabinet access opening and an open position enabling access to said compartment through said cabinet access opening, said first door having an opening therethrough generally aligned with said cabinet access opening when said first door is in said closed position, and a second door carried by said first door for hinged movement between open and closed positions relative to said first door about a second substantially vertical hinge axis laterally offset from said first hinge axis, said second door being of sufficient size to overlie and close said opening in said first door when in closed relation therewith, said first and second doors enabling access to said cabinet compartment through left-hand or right-hand opening of said door arrangement, said cabinet and second door having cooperable seal means to seal the periphery of said cabinet access opening when said first and second doors are in closed relation with said cabinet.

9. A cabinet and door arrangement as defined in claim 8 wherein said first door includes a generally rectangular frame member adapted to overlie the periphery of said cabinet access opening, first non-releasable hinge means connecting said rectangular frame member to said cabinet for hinged movement about said first vertical hinge axis generally adjacent a marginal edge of said cabinet access opening, said first door opening being formed in said frame member and defined by a peripheral inner edge of said frame member adapted to overlie the periphery of said cabinet access opening, said second door being carried by said frame member to overlie said opening in said frame member when in closed relation with said first door, and second non-releasable hinge means interconnecting said second door to said frame member for movement about said second vertical hinge axis laterally offset from said first hinge axis.

10. A door arrangement as defined in claim 9 including first latch means for releasably latching said first door in closed relation to said cabinet, and second latch means for releasably latching said second door to said first door for movement therewith about said first hinge axis.

11. A door arrangement as defined in claim 8 wherein said cooperable seal means includes a seal carried by said second door peripherally thereof to provide a substantially airtight seal with the periphery of said cabinet access opening when said first and second doors are in closed relation to said cabinet access opening.

12. A cabinet and door arrangement as defined in claim 9 wherein said rectangular frame member defines a rectangular opening therethrough of a size substantially similar to said cabinet access opening, said second door being moveable about said second hinge axis to enable access to said cabinet compartment through said rectangular opening.

13. A cabinet and door arrangement as defined in claim 12 wherein said second door is substantially equal in size to an outer perimeter of said rectangular frame member, said second hinge axis being disposed adjacent an edge of the first door laterally opposite said first hinge axis.

14. A cabinet and door arrangement as defined in claim 8 including latch means cooperable with said first and second doors to facilitate latching of said second door to said first door for movement therewith about said first hinge axis.

15. A cabinet and door arrangement as defined in claim 8 including first latch means facilitating releasable latching of said first door in closed relation to said cabinet, and second latch means carried by said second door and enabling latching of said second door to said first door for movement therewith about said first hinge axis.

* * * * *